United States Patent [19]

Bruninga

[11] 4,189,099

[45] Feb. 19, 1980

[54] SPRAY HEAD

[75] Inventor: Kenneth J. Bruninga, Mapleton, Ill.

[73] Assignee: L. R. Nelson Corporation, Peoria, Ill.

[21] Appl. No.: 930,165

[22] Filed: Aug. 2, 1978

[51] Int. Cl.[2] ..... B05B 1/06

[52] U.S. Cl. ..... 239/200; 239/469; 239/491; 239/574; 239/580; 239/582

[58] Field of Search ..... 239/200–205, 239/468, 469, 490, 491, 494, 496, 574, 580–583, DIG. 1

[56] References Cited

U.S. PATENT DOCUMENTS

| | | | |
|---|---|---|---|
| 1,216,630 | 2/1917 | Tuthill | 239/494 |
| 2,076,753 | 4/1937 | Thompson | 239/491 X |
| 2,104,281 | 1/1938 | Thompson. | |
| 2,546,574 | 3/1951 | Wilcox. | |
| 2,591,282 | 4/1952 | Nelson | 239/201 |
| 3,404,841 | 10/1968 | Brittain et al. | 239/204 |
| 3,589,616 | 6/1971 | Stephens | 239/204 |
| 3,650,478 | 3/1972 | Jones | 239/516 |

*Primary Examiner*—Robert W. Saifer

*Attorney, Agent, or Firm*—Cushman, Darby & Cushman

[57] ABSTRACT

A sprinkler spray head consisting of three components preferably molded of plastic material, namely, a body member, a cap member and a flow control member. The mounting and sealing of the components is such that several different spray patterns can be obtained by utilizing several different cap member configurations with the same body and flow control members. The operation of the flow control member is such that flow control adjustment can be obtained by a turning movement from a center position in either direction.

15 Claims, 17 Drawing Figures

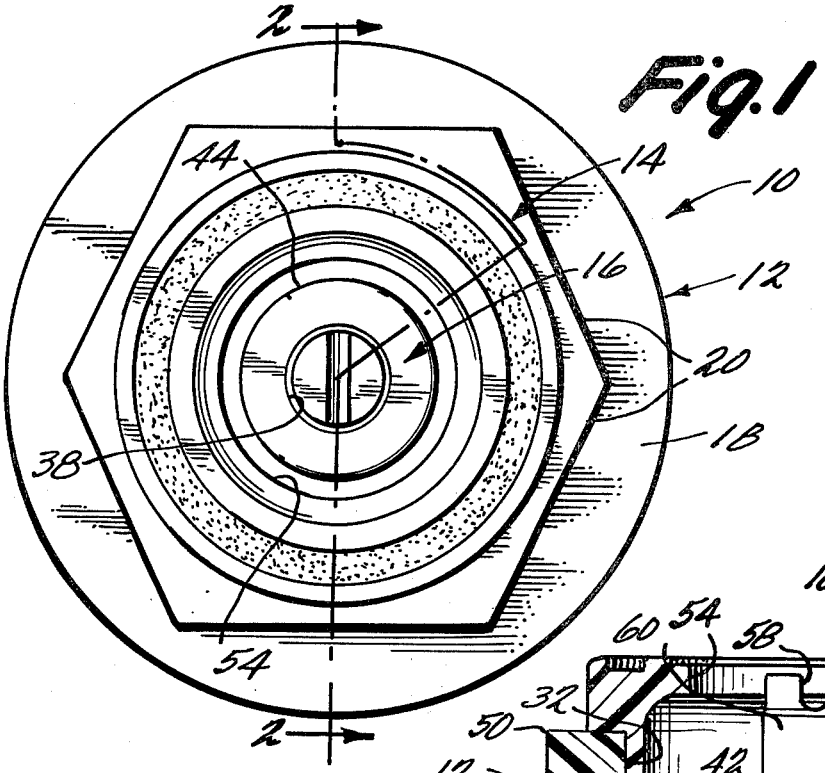
Fig. 1
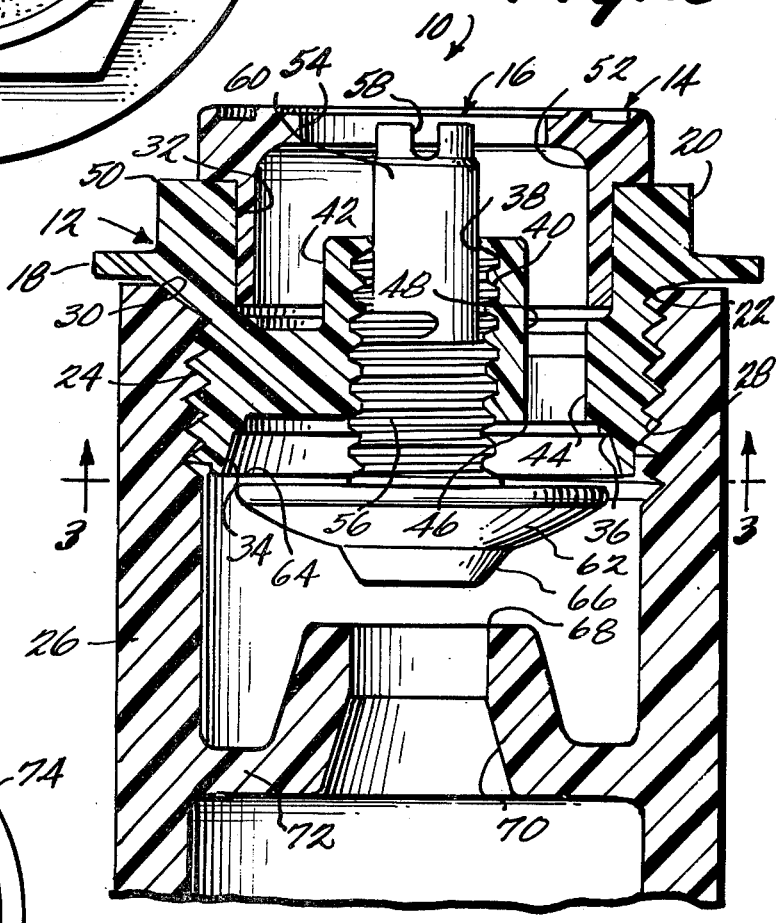
Fig. 2
Fig. 5
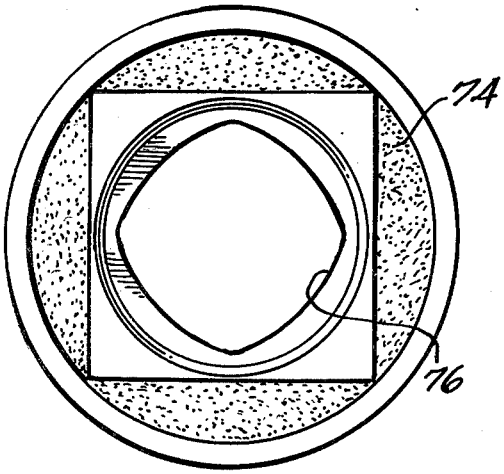

Fig. 8
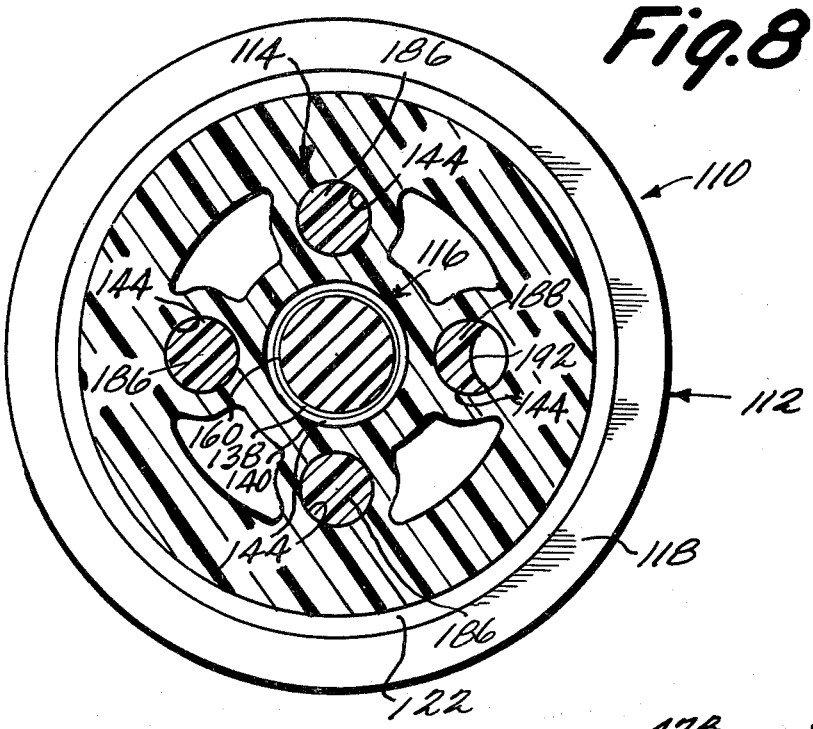
Fig. 17
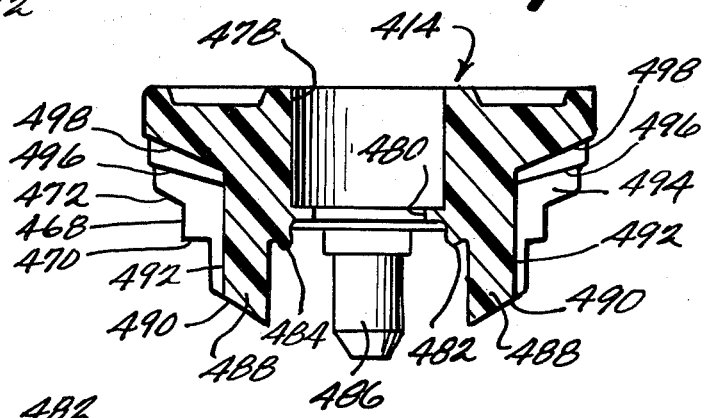
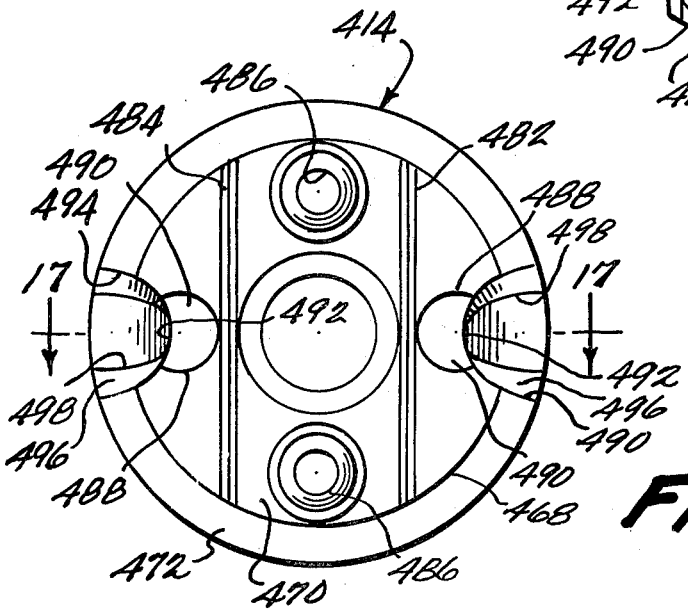
Fig. 16

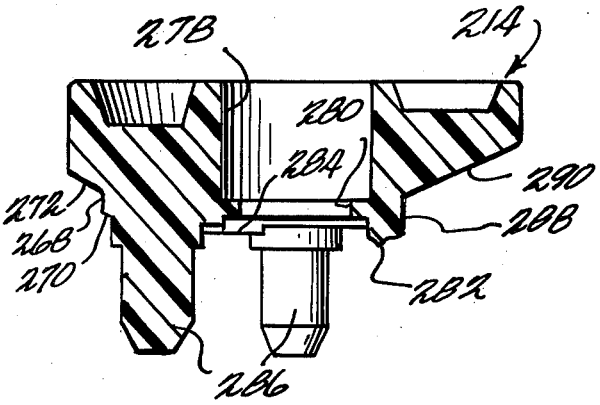
Fig. 13
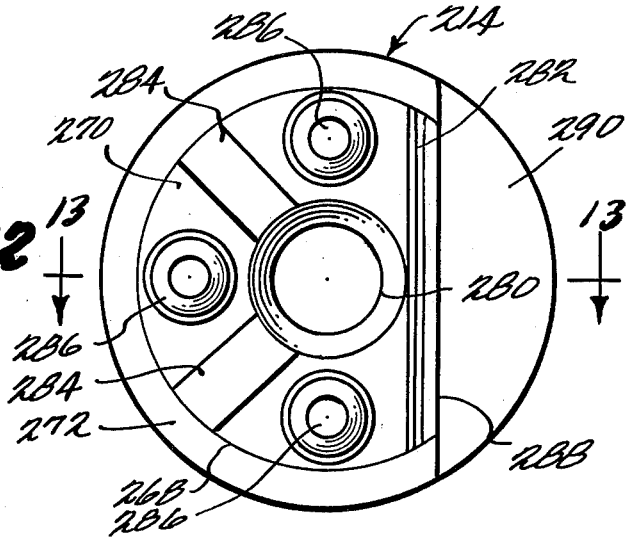
Fig. 12
Fig. 15
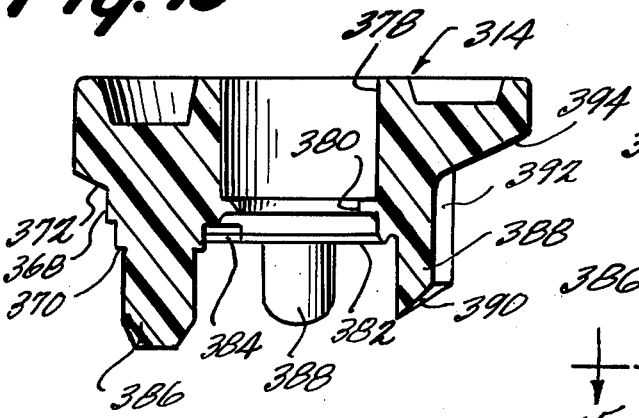
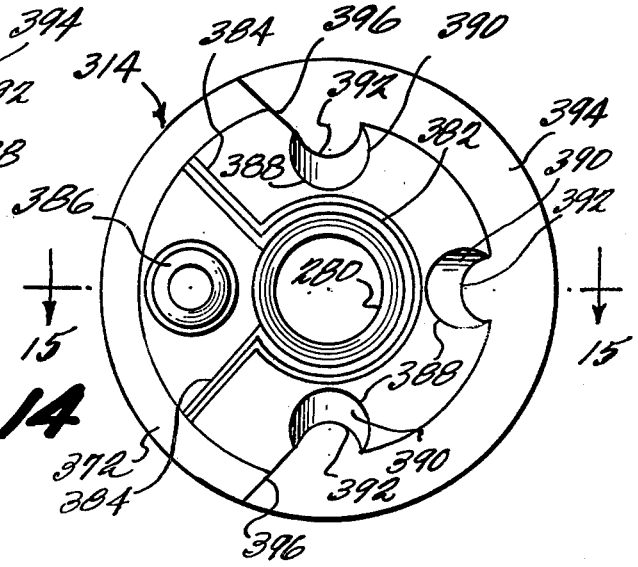
Fig. 14

SPRAY HEAD

This invention relates to sprinklers and more particularly to sprinklers of the spray head type.

Spray head type sprinklers are used in many situations where it is desirable and necessary to distribute water over a predetermined pattern on the ground. One situation presented is in a fixed sprinkler system installed in underground condition on lawns. The spray heads involved may be either of the fixed type or pop-up type. Examples of spray heads of this type are shown in the following patents: U.S. Pat. Nos. 2,104,281; 2,546,574; 3,589,616; and 3,650,478. While spray heads of the type disclosed in the aforesaid patents have proven satisfactory in operation, there is always need for a spray head which will provide comparable performance and is more economical to produce or more versatile in its use.

Accordingly, it is an object of the present invention to provide a spray head which will fulfill the above need. In accordance with the principles of the present invention, this objective is accomplished by providing a spray head which is formed of three separate parts: one, an annular body; two, a cap member, and three, a flow adjusting member. Preferably, all three of the component parts are molded of plastic material. One advantage of forming the spray head of three parts is that it is not necessary to provide a completely different spray head in order to secure different spray patterns, but rather, pattern changes can be effected simply by selecting a particular cap member. Moreover, by molding the flow adjusting member of plastic material rather than utilizing a metal bolt which is conventional, it becomes possible to provide for two control surfaces on the flow adjusting member as well as an exterior cylindrical sealing surface.

The provision of an exterior cylindrical sealing surface is particularly desirable in that such a surface enables a cooperative relationship to be established with an annular sealing lip provided on the spray head body structure. This cooperative relationship serves two very important functions in addition to the basic function of preventing undesired leakage of water under pressure. Prior art flow adjusting members in the form of slotted conventional metal bolts rely upon the interengagement of their exterior threads with the interior threads of the spray head body structure to prevent such leakage. The problem presented by relying upon interengaging threads to provide a water pressure seal is not so much that the interior sealing function becomes ineffective but rather that there is no effective exterior sealing function provided to keep sand and other grit from entering between the interengaging threads and causing malfunctioning of the turning action. The cooperative relation between the cylindrical surface and sealing lip of the present invention eliminates the above-described problem by providing the additional exterior sealing function which prevents sand and grit from reaching the threads. Moreover, this cooperative relationship also secures the second additional function of providing an easily controlled frictional force acting between the two threaded members for retaining them in the position of relative adjustment into which they are moved.

Accordingly, it is a further object of the present invention to provide a spray head of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

In the drawings:

FIG. 1 is a top plan view of one embodiment of a spray head constructed in accordance with the principles of the present invention;

FIG. 2 is a sectional view taken along the line 2—2 of FIG. 1;

FIG. 5 is a top plan view of a cap member providing a square spray pattern which may be utilized with the spray head of FIGS. 1–4 in lieu of the cap member shown therein which provides a circular spray pattern;

FIG. 8 is a sectional view taken along the line 8—8 of FIG. 7;

FIG. 12 is a bottom plan view of another embodiment of a cap member which provides a half-circle spray pattern and which can be used in lieu of the cap member shown in the spray head of FIGS. 6–8;

FIG. 13 is a sectional view taken along the line 13—13 of FIG. 12;

FIG. 14 is a bottom plan view of another embodiment of a cap member which provides a three-quarter circle spray pattern and which can be used in lieu of the cap member shown in the spray head of FIGS. 6–8;

FIG. 15 is a sectional view taken along the line 15—15 of FIG. 14;

FIG. 16 is a bottom plan view of another embodiment of a cap member which provides a center strip spray pattern and which can be used in lieu of the cap member shown in the spray head of FIGS. 6–8; and FIG. 17 is a sectional view taken along the line 17—17 of FIG. 16.

Figure 3:
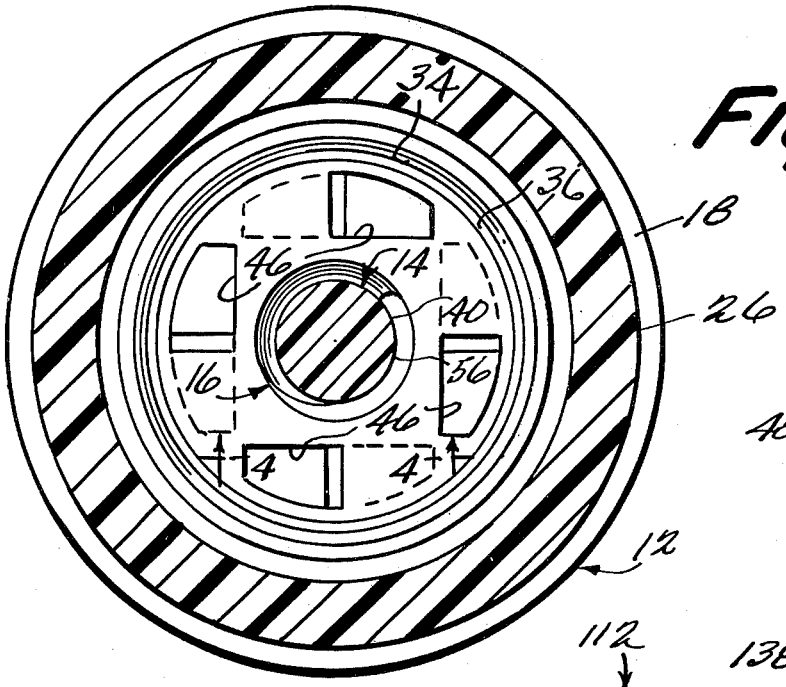
FIG. 3 is a sectional view taken along the line 3—3 of FIG. 2.

Referring now more particularly to FIGS. 1–4, there is shown therein a circular pattern spray head, generally indicated at 10, which embodies the principles of the present invention. The spray head includes three basic parts, all of which are preferably molded of a plastic material. The three parts include a body member, generally indicated at 12; a cap member, generally indicated at 14; and a flow control member, generally indicated at 16.

While any desirable plastic material may be utilized a preferred material for the body member 12 and cap member 14 is ABS plastic, as, for example, Cycolac® type T, and for the flow control member an acetal plastic, as, for example, Celcon® or Delrin®.

The body member 12 is molded to include integral inner and outer annular portions and an intermediate portion therebetween. The outer annular body portion includes an annular flange 18 extending from the central exterior periphery thereof, six flat exterior surfaces 20 defining a hexagonal shaped configuration in a position above the flange, a frustoconical sealing surface 22 extending from the lower portion of the flange and a section of external threads 24 extending downwardly from the frustoconical surface 22. The exterior threads 24, and frustoconical surface 22 serve to fixedly sealingly mount the body member of the head onto an appropriate supply conduit 26. The supply conduit 26 may be a part of a pop-up sprinkler or it may be fixed. In any event, it preferably includes a section of interior threads 28 and an interior frustoconical end surface 30 for cooperatively engaging the exterior threads 24 and frustoconical surface 22 of the body member 12. It will be understood that the mounting of the head on the supply conduit 26 can be effected by a suitable wrench engaging the flat surfaces 20.

The upper interior of the outer annular body portion is defined by a cylindrical cap engaging surface 32 whereas the lower interior of the outer annular body portion is defined by a lower frustoconical flow control surface 34, and a downwardly facing annular seat 36 extending radially inwardly from the inner end of the frustoconical control surface 34.

The inner annular body portion is defined interiorly by a central axial aperture, the upper end of which forms a sealing rim 38 and the remainder of which forms internal threads 40. It will be noted that the diameter of the sealing rim 38 is less than the diameter of the crests of the internal threads 40. The upper exterior of the inner annular body portion is defined by a cylindrical exterior surface 42.

Figure 4:
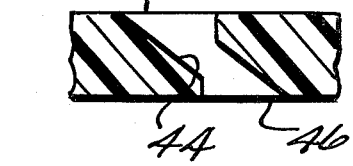
FIG. 4 is a fragmentary sectional view taken along the line 4—4 of FIG. 3.
Figure 10:
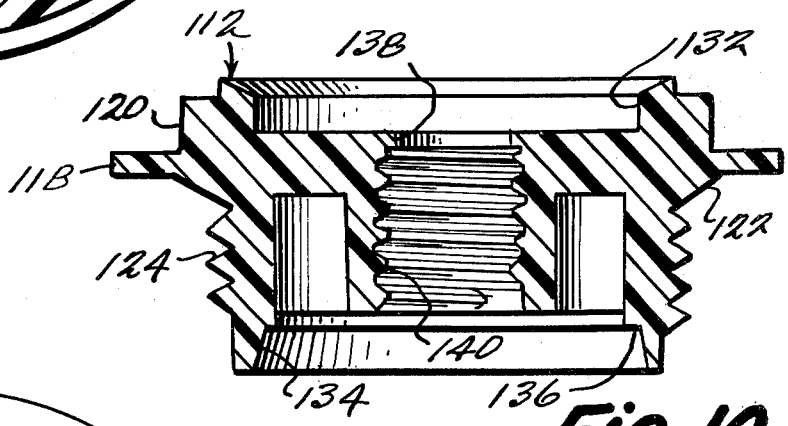
FIG. 10 is a sectional view taken along the line 10—10 of FIG. 9.
Figure 9:
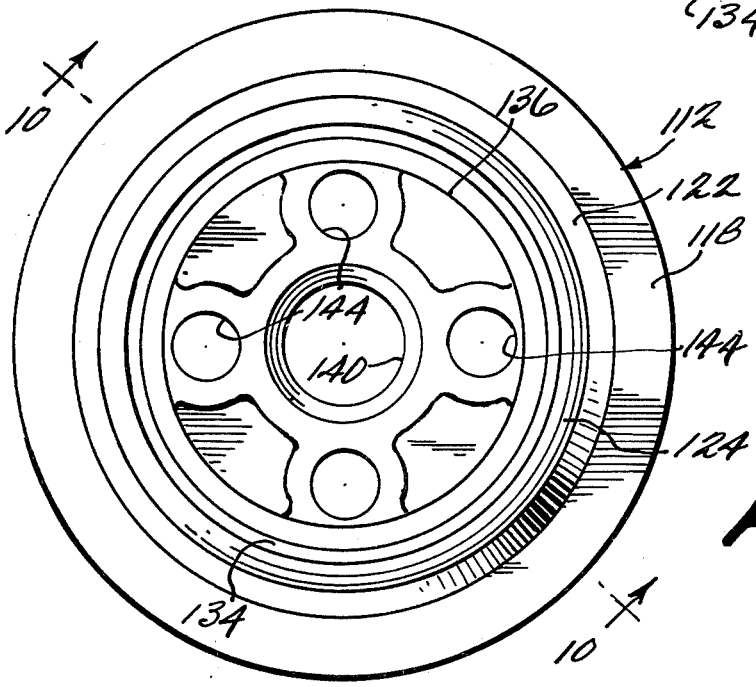
FIG. 9 is a bottom plan view of the body member of the spray head shown in FIGS. 6–8.

The intermediate portion of the body member is shaped to provide four annularly spaced openings 44 having lower inlet ends 46 disposed radially inwardly of the annular seat 36 and outlet ends 48 disposed radially inwardly of the upper cylindrical surface 32 of the outer annular portion of the body member. As best shown in FIG. 4, the cross-sectional configuration of the openings is such that as water flows through the same between the inlet ends 46 and outlet ends 48 a rotational movement about the upright vertical axis of the body member 12 is imparted to the water. As shown, the configuration is formed during molding by two wedge-shaped die parts having angularly related abutting surfaces movable away from one another in opposite axial directions.

The cap member 14 provides a lower exterior cylindrical surface 50 of a size to abuttingly engage the interior cylindrical surface 32 of the body member 12. The upper portion of the cap member extends over the end of the body member and provides an abutting surface therewith which is suitably fixedly engaged as by an appropriate cement or the like. The cap member includes an interior surface 52 of generally inverted bowl-like configuration which serves to peripherally confine the water issuing from the openings 44 having the aforesaid rotational movement. The interior surface 52 communicates with a central outlet passage 54 in the upper end of the cap member which serves to direct the rotating water peripherally confined by the surface 52 radially outwardly and upwardly in a pattern determined by the peripheral configuration. As shown, the passage 54 is circular in peripheral configuration and serves to define a circular spray pattern.

The flow control member 16 includes an intermediate portion having external threads 56 disposed in meshing engagement with the internal threads 40 of the spray head body 12. The upper portion of the flow control member 16 provides a turning capability and, to this end, there is provided a slot 58 of a shape to accommodate a screw driver tool. Other shapes may be provided to accommodate other types of turning tools. The upper portion of the flow control member 16 also provides a cylindrical exterior surface 60 between the slot 58 and threads 56 of a size to be slidably sealingly engaged by sealing rim 38.

Formed integrally on the end of the flow control member 16 is a lower enlarged annular flow control portion 62 having an upwardly facing outer peripheral control surface 64 adapted to cooperate with frustoconical control surface 34 and annular seat 36 of the spray head body 12 to restrict and stop the flow of water under pressure from the source conduit 26 into the inlet ends 46 of the openings 44. The lower flow control portion 62 is also provided with a smaller downwardly and radially outwardly facing frustoconical control surface 66 sized to cooperate with the upper annular surface 68 of a central flow control port 70 formed in a partition wall 72 with the supply conduit 26.

When the spray head 10 is used with the particular partitioned supply conduit 26 shown in FIG. 2, the flow rate of water under pressure available from the source which passes into and through the spray head can be restricted or shut off completely by turning flow control member 16 from the central full open position shown in either direction. Where member 16 is turned in a direction to move control portion 62 upwardly, control surface 64 cooperates first with control surface 34 to restrict and then with slot 36 to shut off. Where member 16 is turning in a direction to lower control portion 62, smaller frustoconical control surface 66 cooperates with fixed control surface 68 to restrict and shut off flow.

In either event, the amount of water flowing around control surface 64 enters the inlet end 46 of the openings 44 and after passing out of the outlet ends 48 enter within the bowl-like surface 52 with a swirling or rotational movement about the central vertical axis of the head 10. This movement of the water within surface 52 results in the same discharging upwardly and outwardly around the circular peripheral surface of opening 54 in a circular pattern on the ground to be sprinkled.

FIG. 5 illustrates a modified form of cap member, indicated generally by the numeral 74, which can be utilized in lieu of the cap member 14. Cap member 74 is constructed identically with cap member 14 except that rather than providing a circular discharge opening 54, the cap member includes a discharge opening 76 providing a square pattern. As shown, the opening 76 is essentially in the form of a square having its sides convexly bowed outwardly rather than straight. The upper surface of the cap member is formed with indicia indicating the square water distribution pattern obtained with the use of the cap member.

Referring now more particularly to FIGS. 6–11, there is shown therein a spray head 110 of modified form embodying the principles of the present invention. As before, the spray head 110 includes three main components, a body member 112, a cap member 114 and a flow member 116 similar to the members 12, 14 and 16 previously described.

As shown, body member 112 includes an outer annular portion having a flange 118, hexagonal flats 120, sealing surfaces 122, and external threads 124. The interior annular portion of the body member includes upper cylindrical cap engaging surface 132, lower frusto-conical flow control surface 134, annular seat 136, internal threads 138 and upper sealing rim 140. As before, the intermediate portion of the body member 112 is shaped to provide four annularly spaced openings 144 having lower inlet ends 146 and upper outlet end 148, however rather than being in the swirl-inducing configuration shown in FIG. 4, the openings 144 are of generally stepped cylindrical configuration.

The flow control member 116 is substantially identical with member 16 and includes external threads 156, upper turning slot 158, exterior cylindrical sealing surface 160, enlarged flow control portion 162, upper peripheral control surface 164 and lower frustoconical control surface 166.

Figure 7:
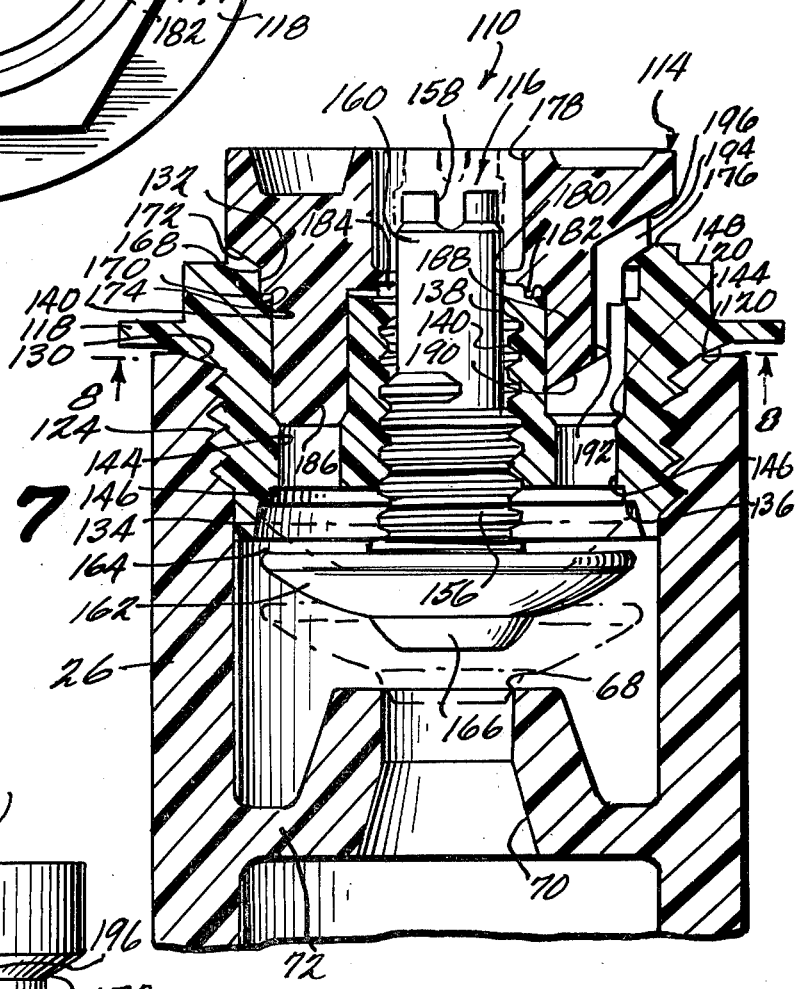
FIG. 7 is a sectional view taken along the line 7—7 of FIG. 6.
Figure 11:
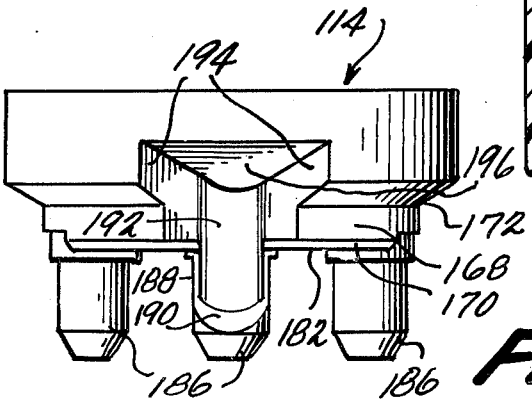
FIG. 11 is a front elevational view of the cap member of the spray head shown in FIGS. 6–8 which provides a quarter-circle spray pattern.

Referring now more particularly to FIGS. 7, 8 and 11, the cap member 114 includes a central exterior body engaging cylindrical surface 168 which is adapted to be disposed in fixedly engaged relation with cap-engaging cylindrical surface 132. The lower end of cylindrical surface 168 leads to a downwardly facing horizontal surface 170 while the upper end thereof leads to a frustoconical surface 172. Body member 112 has the lower end of its cylindrical cap engaging surface 132 leading to an upwardly facing horizontal surface 174 and the upper end thereof leading to a peripheral frustoconical surface 176.

The cap member 114 also includes a central aperture 178 extending axially therethrough which receives the turnable upper end portion of the flow control member 116 provides vertical access to the turning slot 158 thereof. Sealing means is provided for preventing water from reaching the aperture 178. As shown, such sealing means includes an integral annular sealing lip 180 disposed in the lower end of aperture 178 and having a slidable sealing relationship with cylindrical surface 160 of the flow control member 116. In addition, an integral straight sealing lip 182 is formed in depending relation to the surface 170 and arranged in sealing engagement with the upwardly facing horizontal surface 174 of the body member 112.

Figure 6:
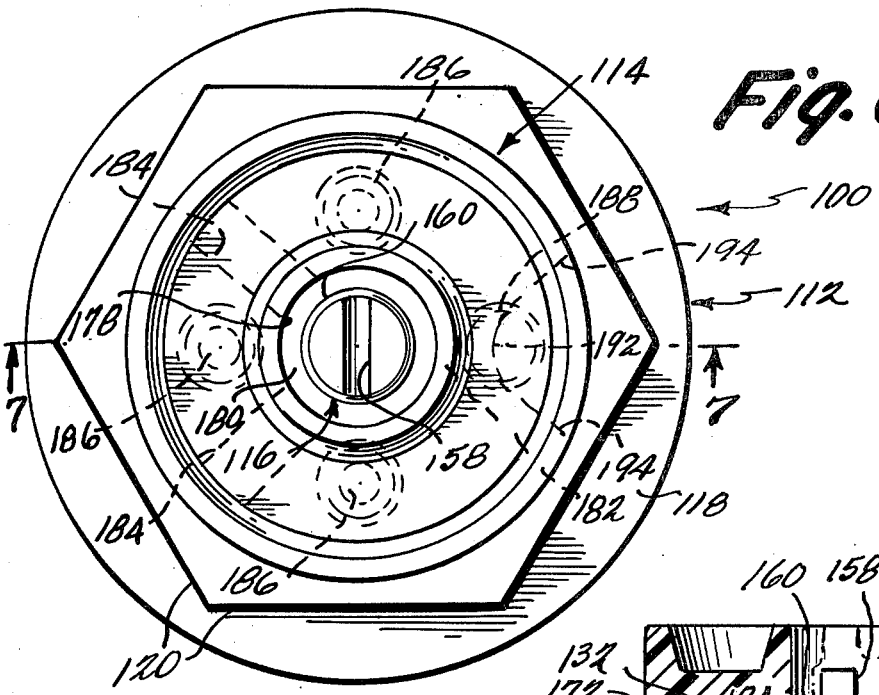
FIG. 6 is a top plan view of another embodiment of a spray head constructeu in accordance with the principles of the present invention.

As best shown in FIG. 6, in order to balance the engagement of the sealing lip 182 with the horizontal surface 174, a pair of annularly spaced radially extending abutments 184 is formed in the remaining segment of the cap member in depending relation to the horizontal surface 170 thereof.

The cap member 114 provides interior surfaces which define a discharge passage for the water to distribute the water within a quarter-circle pattern. To this end, the interior surfaces which define the passage are all formed in a position underlying one of the passages 144 of the body member 112. As a further aid in fixedly mounting the cap member 114 within the body member and to effect the aforesaid sealing function, the cap member 114 is provided with three annularly spaced depending plug portions 186 which are configured to closely engage within the upper cylindrical step of three of the four openings 144, thus plugging the outlet ends 148 thereof.

The configuration of the interior discharge passage surfaces which define the water pattern is best shown in FIGS. 7 and 11. In this regard, it will be noted that the cap member includes a fourth plug member 188, however this plug member has its lower surface cut away at an upwardly and radially outwardly extending angle, as indicated at 190. A preferred angle for the surface 190 is approximately 30° to the horizontal. The radially outward section of the plug portion 188 is cut away to form an arcuate interior vertically extending surface 192. An example of the configuration of the surface 192 is that its radius is equal to the radius of the plug portion 188 with the center of the arc being disposed at the radially outermost point of the plug element. The arcuate surface 192 extends upwardly into the cap member 114 to a position approximately equal to the outer edge of the frustoconical surface 172. The two arcuate extremities of the arcuate surface 192 are modified so as to extend generally tangentially as indicated at 194. An exemplary tangential configuration is one in which the angle between the tangential surfaces is approximately 96°. Finally, the interior flow passage defining surfaces include an upwardly and outwardly extending generally flat surface 196 which joins with the upper end of the arcuate surface 192 and tangential surfaces 194. An exemplary angular inclination of the surface 196 is approximately 25° to the horizontal.

It will be seen that the flow control member 116 within the spray head 110 functions in a manner similar to the manner in which the flow control member 16 functions within the spray head 10 previously described. All of the water from the source which flows past the enlarged flow control portion 162 of the control member 116 passes into the inlet end 146 of the single unplugged opening 144. As the water passes through the unplugged opening 144, its direction of flow is defined by the interior surfaces of the cap member 114 including lower flat surface 190, arcuate surface 192, tangential surface 194 and inclined surface 196. These interior surfaces combine with the associated surfaces of the body member to define a single discharge flow passage of the spray head 110 which achieves a quarter-circle spray pattern on the ground to be sprinkled.

The spray head 110, like the spray head 10, is advantageous in that it has the capability of providing a number of spray patterns by simply replacing the quarter-circle pattern cap member 114 with other cap members configured to provide other spray patterns. For example, FIGS. 12 and 13 illustrate a cap member 214 which is provided with interior surfaces configured to define a half-circle spray pattern. As shown, the cap member 214 is similar to the cap member 114 in that it includes a central exterior body engaging cylindrical surface 268, the lower end of which leads to a downwardly facing horizontal surface 270 and the upper end of which leads to a frustoconical surface 272. The cap member 214 also includes a central aperture 278 having an integral annular sealing lip 280 formed in the lower end thereof. Also, as before, there is provided a straight sealing lip 282 and a pair of annularly spaced radially extending abutments 284. In addition, the cap member 214, like the cap member 114, includes three depending plug portions 286. However, unlike the cap member 114, the cap member 214 does not include a fourth cut-away plug member 188 with inclined surfaces 190 and arcuate surfaces 192. Instead, in a position above the unplugged opening 144, a cordal vertical surface 288 is formed in the cap member 214, the upper end of which intersects with the inner end of an upwardly and outwardly extending generally frustoconical surface 280. The arrangement is such that when the cap member 214 is disposed in operative relation with the sprinkler body 112, the surfaces 288 and 290 define with the cooperating surfaces of the body member 112 a discharge flow passage which achieves a half-circle flow pattern on the area to be sprinkled.

Referring now more particularly to FIGS. 14 and 15, there is shown therein a cap member 314 which is provided with interior surfaces configured to define a three-quarter circle spray pattern. The cap member 314, like the cap member 214 and 114, includes a central exterior body engaging cylindrical surface 368, the lower end of which leads to a downwardly facing horizontal surface 370 and the upper end of which leads to a frustoconical surface 372. The cap member 314 also includes a central aperture 378 having an integral annular sealing lip 380 formed in the lower end thereof. Instead of a straight depending sealing lip 282, the cap member 314 provides a depending sealing lip of composite design which includes an intermediate arcuate portion 382 of an arcuate extent slightly greater than 270° and a pair of radially outwardly extending straight end portions 384. The cap member 314 includes only a single full plug portion 386 and provides three cut-away plug portions 388, each having a configuration generally similar to the cut-away plug portion 188 of the cap 114. Thus, each cut-away plug portion includes a lower inclined surface 390 and an outer vertically extending arcuate surface 392. Each arcuate surface 392 extends upwardly into the cap member 314 and intersects with the inner end of a segmental frustoconical surface 394. As before, the two diametrically opposed arcuate surfaces 392, as well as the ends of the upwardly and outwardly extending surface 394, are defined by two spaced tangential surfaces 396. An exemplary included angle between each tangential surface and a vertical axial plane passing through the cap member 314 is approximately 48°.

FIGS. 16 and 17 illustrate a cap member 414 having interior surfaces configured to provide a center strip pattern. Here again, the cap member 414 includes a central exterior body engaging cylindrical surface 468, the lower end of which leads to a downwardly facing horizontal surface 470 and the upper end of which leads to a frustoconical surface 472. The cap member 414 also includes a central aperture 478 having an integral annular sealing lip 480 formed in the lower end thereof.

The cap member 414 includes a straight sealing lip 482 similar to lip 182, however, in lieu of the abutments 184 previously described in relation to the cap member 114, there is provided a second depending sealing lip 484 which is parallel and symmetrical to the depending straight sealing lip 482. The cap member 414 includes two diametrically opposed plug portions 486 and two diametrically opposed cut-away plug portions 488. Each of the cut-away plug portions 488 is constructed with cut away surfaces similar to the surfaces 190 and 192 previously described. As shown, the lower inclined surface 490 is inclined at an angle of 30°, similar to the surface 190. The outer section of each cut-away plug portion 488 is defined by an arcuate surface 492, however, this arcuate surface has a radius slightly greater than the radius of the surface 192 of the cap member 114 and does not extend radially inwardly as far as the arcuate surface 192. As before, each arcuate surface 492 extends upwardly within the cap member 414 and the arcuate extremities thereof are modified to provide tangential surfaces 494. The included angle between these tangential surfaces, however, is approximately 40°. The upper ends of the arcuate surfaces 492 and tangential end surfaces 494 intersect with an upwardly and outwardly extending surface 496, the central portion of which has a recess 498 formed therein. The shape of the recess 492 is generally similar to the shape defined by arcuate surface 492, tangential surfaces 494 and inclined surfaces 496. However, the configuration differs, in that the arcuate surface is of a smaller radius and the tangential surfaces define an angle of 20° therebetween. The inclined surface defines an angle of approximately 22° with the horizontal, whereas the inclination of the surface 496 is approximately 13° to the horizontal.

It will be understood that an end strip pattern cap member may be provided which is configured like the cap member 414 except that only one cut-away plug portion 488 is provided, rather than two, while three plug portions 486 are provided. In addition, straight sealing lip 484 would be replaced by a pair of abutments similar to the abutments 184 previously described.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A spray head comprising:

an annular body molded of plastic material including integral inner and outer annular portions and an intermediate portion therebetween, said outer annular body portion having means on the exterior thereof for fixedly sealingly engaging the upper end of a supply conduit communicating with a source of water under pressure including a section of exterior threads for threadingly cooperating with interior threads on the supply conduit, lower annular flow control surface means disposed in a position to communicate with the water under pressure when said body is fixedly sealingly engaged with a supply conduit as aforesaid, and upper annular cap engaging surface means disposed in a position exterior of the supply conduit when said body is fixedly sealingly engaged therewith, said intermediate body portion defining a plurality of annularly spaced openings having lower inlet ends disposed radially inwardly of said annular flow control surface means in communicating relation therewith and axially spaced upper outlet ends disposed radially inwardly of said upper annular cap engaging surface means in communicating relation therewith, an annular cap member molded of plastic material having body engaging annular surface means disposed in fixed engagement with said upper annular cap engaging surface means and interior surface means defining at least one spray passage communicating with the outlet end of at least one of said openings for directing water flowing from said outlet into a predetermined spray pattern, said inner annular body portion having a central axial aperture extending therethrough formed with internal threads, said cap member being devoid of material in a position axially above said central axial aperture, a flow adjusting member including an intermediate portion having external threads disposed in meshing engagement with said internal threads, a turnable upper portion disposed in upwardly exposed relation so as to be engaged from above to effect a turning of said adjusting member and through the meshing of said threads an axial movement of said adjusting member with respect to said body and a lower enlarged annular flow control portion movable toward and away from said lower flow control annular surface means for causing water under pressure communicated with the supply conduit when said body is fixedly sealingly engaged therewith as aforesaid to flow between the periphery of said annular flow control portion and said lower annular flow control surface means before entering the inlet ends of said openings so that the position of axial adjustment of said enlarged flow control portion with respect to said flow control surface means can be utilized to control the flow rate of water under pressure available from the supply conduit entering the inlet ends of said openings.

2. A spray head as defined in claim 1 wherein said inner annular body includes an integral radially inwardly extending annular sealing rim defining the upper end portion of said central axial aperture, said sealing rim having a diameter less than the diameter of the crests of said internal threads, the turnable upper portion of said flow adjusting member having a cylindrical exterior surface of a diameter less than the diameter of the troughs of said external threads, said sealing rim being disposed in sealing engagement with said cylindrical exterior surface.

3. A spray head as defined in claim 1 wherein said lower enlarged annular flow control portion includes a downwardly and radially outwardly facing frustoconical surface for controlling the flow of water through a restricted central opening in said supply conduit.

4. A spray head as defined in claim 1, 2 or 3, wherein said plurality of annularly spaced openings are defined by surface means operable to impart rotational movement about a central vertical axis to the water flowing outwardly of the outlet ends thereof, the interior surface means of said cap member defining an inverted bowl-like configuration having a central outlet passage in its upper end operable to peripherally confine the rotating water issuing from the outlet ends of said openings and to direct the same radially outwardly and upwardly in a pattern determined by the peripheral configuration of said passage.

5. A spray head as defined in claim 4 wherein the peripheral configuration of said passage is circular and said pattern is circular.

6. A spray head as defined in claim 4 wherein the peripheral configuration of said passage is a square with convexly bowed sides and said pattern is square.

7. A spray head as defined in claim 1, 2 or 3 wherein each of said plurality of annularly spaced openings is of circular cross-sectional configuration, said cap member including integral depending plugging means disposed in fixedly secured and plugged relation to certain of said openings, a central aperture extending axially therethrough providing access to the turnable upper end portion of said flow control member, said interior surface means facing downwardly and outwardly in cooperating relation with certain other of said openings, and sealing means between said interior surface means and said aperture for preventing liquid from said certain other of said openings from reaching said aperture.

8. A spray head as defined in claim 7 wherein said sealing means includes an annular sealing lip formed integrally on said cap member in a position at the lower end of said aperture disposed in peripheral sealing engagement with said flow control member.

9. A spray head as defined in claim 7 wherein said plugging means includes a plurality of plug portions plugging all but one of said openings, the downwardly and outwardly facing pattern defining surface means of said cap member being disposed over said one opening and extending to the periphery of the cap member within a predetermined segment thereof, said sealing means including a depending integral sealing lip extending across said cap member in a position between said predetermined segment and the remainder of said cap member, said depending sealing lip engaging an upwardly facing horizontal surface on said body member.

10. A spray head as defined in claim 9 wherein said pattern defining downwardly and outwardly facing surface means is shaped to define a quarter circular pattern.

11. A spray head as defined in claim 9 wherein said pattern defining downwardly and outwardly facing surface means is shaped to define a semi-circular pattern.

12. A spray head as defined in claim 7 wherein said plugging means includes a single plug portion plugging one certain opening, the downwardly and outwardly facing pattern defining surface means being disposed over the remaining openings and extending to the periphery of the cap member within a predetermined segment thereof greater than a semi-circular segment so as to define a three-quarters circular pattern, said sealing means including a depending integral sealing lip extending across said cap member in a position between said predetermined segment and the remainder of said cap member, said depending sealing lip engaging an upwardly facing horizontal surface on said body member.

13. A spray head as defined in claim 7 wherein said plugging means includes a pair of diametrically opposed plug portions plugging a certain pair of diametrically opposed openings, the downwardly and outwardly facing pattern defining surface means being disposed in two spaced positions over a certain other pair of openings and extending to diametrically opposed peripheral portions of the cap member within predetermined opposed segments thereof, so as to define an elongated strip pattern, said sealing means including a pair of depending integral sealing lips extending across said cap member in positions between said predetermined segments and the remainder of said cap member, said pair of depending sealing lips engaging an upwardly facing horizontal surface on said body member.

14. A sprinkler comprising a supply tube adapted to be connected with a source of water under pressure, said supply tube having an inner annular wall defining a central restricted flow passage, a spray head fixedly mounted within the upper end of said supply tube in a position above said inner annular wall, said spray head comprising an annular body molded of plastic material including integral inner and outer annular portions and an intermediate portion therebetween, said outer annular body portion having means on the exterior thereof fixedly sealingly engaging the upper end of a supply tube including a section of exterior threads threadingly cooperating with interior threads on said supply tube, lower annular flow control surface means disposed in a position to communicate with the source of water under pressure, and upper annular cap engaging surface means disposed in a position exterior of the supply conduit when said body is fixedly sealingly engaged therewith, said intermediate body portion defining a plurality of annularly spaced openings having lower inlet ends disposed radially inwardly of said annular flow control surface means in communicating relation therewith and axially spaced upper outlet ends disposed radially inwardly of said upper annular cap engaging surface means in communicating relation therewith, an annular cap member molded of plastic material having body engaging annular surface means disposed in fixed engagement with said upper annular cap engaging surface means and interior surface means defining at least one spray passage communicating with the outlet end of at least one of said openings for directing water flowing from said outlet into a predetermined spray pattern, said inner annular body portion having a central axial aperture extending therethrough formed with internal threads, said cap member being devoid of material in a position axially above said central axial aperture, a flow adjusting member including an intermediate portion having external threads disposed in meshing engagement with said internal threads, a turnable upper portion disposed in upwardly exposed relation so as to be engaged from above to effect a turning of said adjusting member and through the meshing of said threads an axial movement of said adjusting member with respect to said body and a lower enlarged annular flow control portion movable toward and away from (1) said lower flow control annular surface means for causing water under pressure communicated with said supply tube to flow between the periphery of said annular flow control portion and said lower annular flow control surface means before entering the inlet ends of said openings so that the position of axial adjustment of said enlarged flow control portion with respect to said flow control surface means can be utilized to control the flow rate of water under pressure available from the supply tube entering the inlet ends of said openings and (2) said inner annular wall so that the position of axial adjustment of said enlarged flow control portion can be utilized to control the flow rate of water under pressure passing from said restricted flow passage to said spray head.

15. A sprinkler comprising a spray head structure having means on the exterior periphery thereof for fixedly sealingly engaging a supply conduit communicating with a source of water under pressure, a section of internal threads extending upwardly from the central lower portion thereof and an axially aligned annular sealing rim above said section of internal threads of a diameter size less than the diameter size of the crests of the internal threads of said section, a flow adjusting member having an intermediate portion formed with external threads threadedly interengaged with said internal threads so that said flow adjusting member is moved vertically with respect to said spray head structure in response to a rotational movement thereof with respect to said spray head structure, said spray head structure having water flow opening means therein extending from the lower interior thereof to the upper exterior thereof for directing water from said supply conduit onto a predetermined pattern to be sprinkled, said flow adjusting member having a portion disposed below said internal threads for controlling the amount of flow of water through said water flow opening means in accordance with the relative vertical position of said flow adjusting member with respect to said spray head structure, said flow adjusting member having a turnable upper end portion disposed in upwardly exteriorly exposed relation with respect to said spray head structure formed with an exterior cylindrical surface disposed in cooperatively engaged relation with said annular sealing rim so as to (1) sealingly prevent the leaking of water under pressure exteriorly thereby, (2) sealingly prevent the passage of exterior sand and grit interiorly thereby and (3) frictionally retain said flow adjusting member in any position of adjustment into which it is moved with respect to said spray head structure.

* * * * *